US006732896B2

(12) United States Patent
Brazell

(10) Patent No.: US 6,732,896 B2
(45) Date of Patent: May 11, 2004

(54) APPARATUS AND PROCESS FOR DIVIDING A NONWOVEN WEB

(75) Inventor: James W. Brazell, Atlanta, GA (US)

(73) Assignee: Georgia Tech Research Corp., Atlanta, GA (US)

( * ) Notice: Subject to any disclaimer, the term of this patent is extended or adjusted under 35 U.S.C. 154(b) by 3 days.

(21) Appl. No.: 10/021,281

(22) Filed: Oct. 30, 2001

(65) Prior Publication Data

US 2002/0081928 A1 Jun. 27, 2002

Related U.S. Application Data

(60) Provisional application No. 60/249,484, filed on Nov. 17, 2000.

(51) Int. Cl.[7] ..... B26F 3/02; B65H 35/10

(52) U.S. Cl. ..... 225/101; 225/99; 225/106

(58) Field of Search ..... 225/100, 101, 225/106, 98, 99

(56) References Cited

U.S. PATENT DOCUMENTS 2,308,551 A * 1/1943 Sherman ..... 225/3
2,753,936 A * 7/1956 MacChesney ..... 83/808
3,182,875 A * 5/1965 Fleming ..... 225/99
3,529,756 A * 9/1970 Smith ..... 225/99
3,797,719 A * 3/1974 Tall et al. ..... 225/100
5,092,697 A * 3/1992 McKenna ..... 400/621.1
5,197,643 A * 3/1993 Augustin ..... 225/93
5,505,551 A * 4/1996 Rutherford ..... 400/621
6,467,763 B1 * 10/2002 Depoi et al. ..... 270/52.09

* cited by examiner

*Primary Examiner*—Allan N. Shoap
*Assistant Examiner*—Isaac Hamilton
(74) *Attorney, Agent, or Firm*—Thomas, Kayden, Horstemeyer & Risley LLP

(57) ABSTRACT

An apparatus and process for dividing a nonwoven web into a plurality of ribbons. An assembly of converging ribbons receive and grip the incoming continuous web to create a travel distance differential. One portion of the continuous web is pulled through the assembly of belts at a different velocity than another adjacent portion of the continuous web. Because adjacent portions of the continuous web travel a different distance over a period of time, the orientation of fibers in the web between the two adjacent portions of the web is altered. As the fibers become oriented in the machine direction, the web begins to split into continuous ribbons of desired width.

17 Claims, 7 Drawing Sheets

APPARATUS AND PROCESS FOR DIVIDING A NONWOVEN WEB

RELATED APPLICATIONS

This application claims the benefit of prior now abandoned U.S. Provisional Patent Application Ser. No. 60/249,484, filed Nov. 17, 2000, entitled "Apparatus and Process for Dividing a Nonwoven Web."

TECHNICAL FIELD

The present invention relates to processing a web of fibers into thread and, more particularly, relates to dividing a nonwoven web into multiple continuous ribbons.

BACKGROUND OF THE INVENTION

Yarn is a strand composed of fibers, filament, or other materials, either natural or man-made, suitable for use in the manufacture of fabrics. Most fiber processing operations are performed by mechanical means. Typically, natural fibers such as cotton, or man-made materials, are shipped in bales to a textile mill for yarn manufacturing. The traditional processing method involves subjecting the bail of cotton to opening and cleaning, picking, carding, combing, drawing and spinning.

The cotton bale is opened and its fibers are raked mechanically to remove foreign matter. A picker then wraps the fibers into a lap. A carding machine brushes the loose fibers into rows that are joined as a soft continuous nonwoven sheet, or web, and forms them into loose untwisted rope known as card sliver. For higher quality yarn, the sliver is put through a combing machine, which strengthens the fibers to a finer degree. In the drawing stage, rollers reduce the sliver to a uniform strand of a usable size. The drawing stage is also commonly referred to as the drafting stage. Even thinner strands may be produced by pulling and slightly twisting the sliver. Finally, the sliver is transferred to a spinning frame, where it is drawn further, and wound on a bobbin as yarn.

However, the drawing process to reduce the sliver to a usable size, and then the pulling on the sliver to reduce the sliver further, are time and space consuming steps of the yarn making process. Eliminating the drawing and the pulling of the sliver would create a faster, more efficient, yarn making process.

Therefore, there is a need for an apparatus and process for dividing a continuous, nonwoven web from the carding machine into a plurality of continuous ribbons. The present invention must forego the drawing and pulling of the web into a sliver, but permit the ribbons to be manufactured according to desired widths with a uniform linear density.

SUMMARY OF THE INVENTION

The present invention solves the above-identified problems by providing an apparatus and process for dividing a continuous web into a plurality of continuous ribbons. The present invention utilizes differences in travel distance of different portions of the continuous web to achieve fiber parallelization and repetition. The difference in travel distance between portions of the continuous web is achieved by creating a velocity differential between adjacent portions of the web over a fixed period of time.

Generally described, the present invention includes an apparatus for providing a plurality of continuous ribbons from a continuous nonwoven web. The apparatus includes an assembly of converging belts. At least two pairs of converging belts lie longitudinally adjacent to one another. Each pair of converging belts cooperate to receive and grip the incoming continuous web. At least one pair of converging belts varies the speed of one portion of the continuous web relative to another adjacent portion of the continuous web driven by the other pair of converging belts. Because adjacent portions of the continuous web are driven at different speeds, the continuous web is divided in a longitudinal manner into two continuous ribbons of desired width.

According to one aspect of the invention, a wheel sized to facilitate shearing engages and places pressure on each pair of converging belts. Because the belts are then urged against the continuous web, the continuous web is gripped by the belts.

According to another aspect of the invention, a pair of pressure pads persuades a pair of converging belts against the continuous web. The pressure pads are laterally spaced from one another and substantially coextensive. The pressure pads are moveable with respect to one another to permit the pair of belts to pass therebetween.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

Similar reference characters refer to similar parts throughout the several views of the drawings.

DETAILED DESCRIPTION

Figure 1:
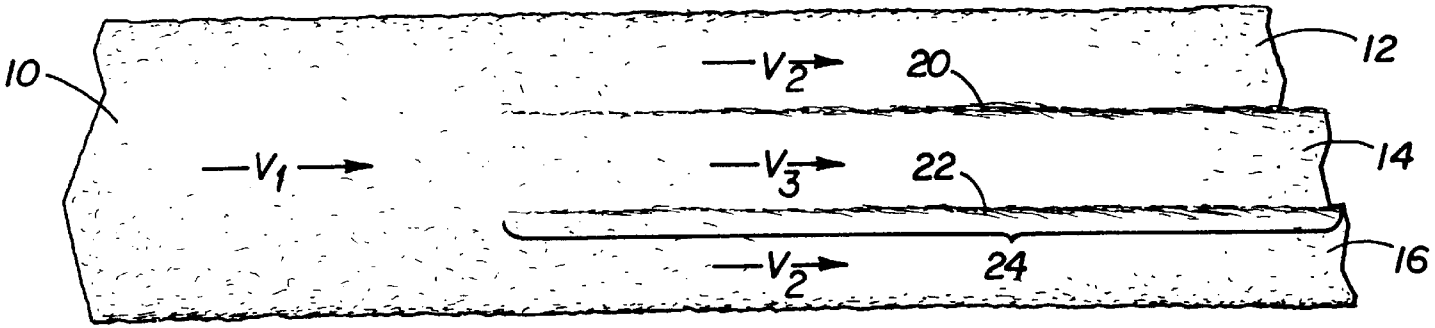
FIG. 1 illustrates the orientation of fibers in a portion of a continuous nonwoven web as it moves through the present invention.

Referring now to the drawings in which like numerals indicate like elements throughout the several views, FIG. 1 illustrates an exemplary embodiment of the general operation of splitting a continuous nonwoven web 10 into continuous ribbons 12, 14 and 16. While a particular embodiment of the present invention may be described with reference to a particular number of continuous ribbons, it is understood that the present invention may be adapted to split the continuous web 10 into any number of continuous ribbons.

In FIG. 1, the nonwoven web is made up of a mass of fibers such as in cotton or polyester. As a result of altering the orientation of the fiber along lines 20 and 22, the web 10 is split along lines 20 and 22. A typical fiber spanning the space between the adjacent ribbons will gradually be pulled in the longitudinal direction until it breaks or is pulled loose from one of the ribbons. A plurality of fibers 24 is illustrated along line 22. The line 22 defines the split between adjacent continuous ribbons 14 and 16. The fibers 24 on the left side of line 22, where the web 10 is only beginning to split, are oriented substantially in an transverse manner relative to the machine direction of the web 10. However, as the fibers 24 become more longitudinally oriented, in the machine direction, the web 10 begins to split along the line 22. The portion of FIG. 1 having reference number 24 could also be used to visualize the orientation of a single fiber as it progresses through the process to achieve fiber parallelization.

Figure 2:
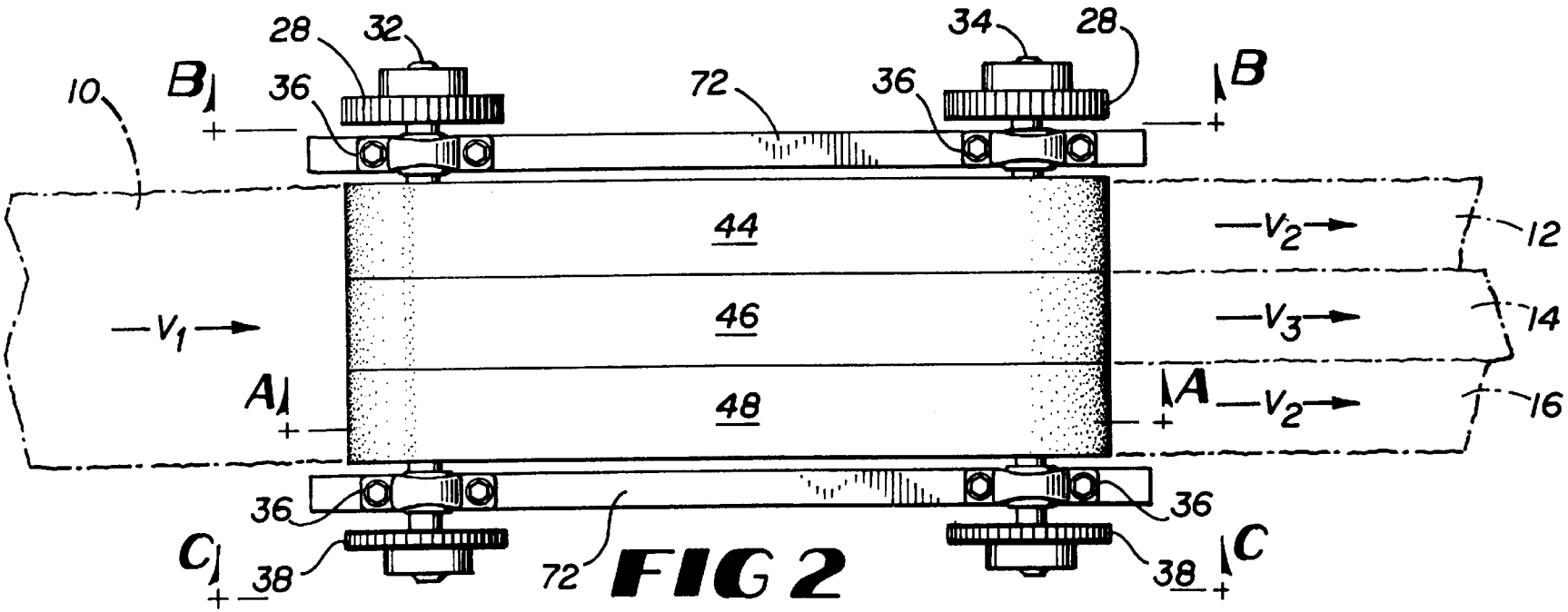
FIG. 2 illustrates a top view of one embodiment of the present invention having two synchronized pairs of converging belts for receiving the continuous nonwoven web.

As shown generally in FIG. 2, the present invention includes an assembly of converging belts for receiving a continuous web at a velocity $V_1$. The assembly of belts includes at least two pair of converging belts for gripping the continuous web 10. For example, the belts are flat belts obtained from Habasit Belting, Inc. The surfaces of the belts may be smooth, textured or otherwise formed to enhance the grip on the web 10. The belts may also be coated with a substance such as Teflon® to achieve the desired surface.

Figure 4:
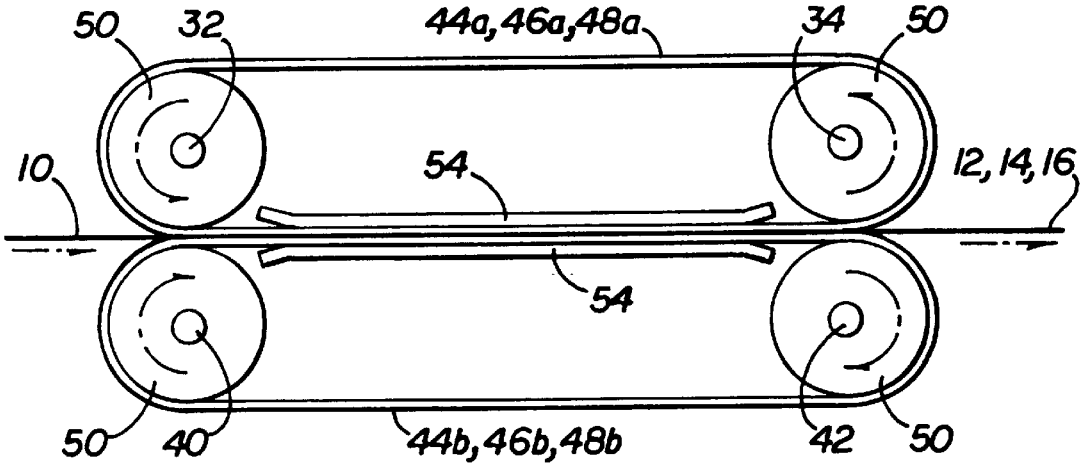
FIG. 4 is a side view of one embodiment of one pair of converging belts adapted to be urged against the incoming continuous web by a pair of pressure pads.

A portion of one belt of a pair of converging belts is coextensive with a portion of the other corresponding belt of the pair of converging belts (FIG. 4). Preferably, the coextensive portions of each pair of belts are vertically opposed to one another. The length of the coextensive portion for gripping the web 10 is dependent on the velocity desired for the ribbons. A longer coextensive portion only needs a smaller speed differential because a longer distance is traveled in order to split the web 10. For example, a 2 inch differential, which is not a large differential, could occur over a 50 inch travel. As best shown in FIG. 2, each pair of converging belts is placed along side one another to align the coextensive portions in the machine direction for the entire width of incoming continuous web. Moreover, the widths of the resulting continuous ribbons depends on the width of each pair of converging belts.

One pair of converging belts grips a portion of the incoming continuous web and the other pairs grip another portion of the continuous web. Each pair of converging belts is driven at a velocity different from the immediately adjacent pair of converging belts. Preferably, the relative speeds are varied by approximately 4% to 10%. However, the determining factors are machine dimension dependent. For example, a 10% speed differential may be obtained by a smaller wheel compared to a 4% speed differential obtained from a larger wheel and, in either case, the desired travel distance differential would be the same. Preferably, the travel distance differential is approximately the fiber length.

Figure 3:
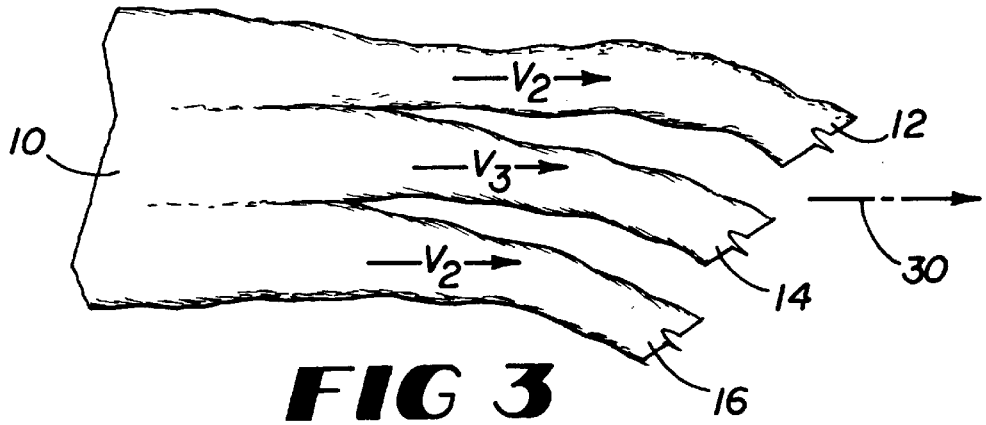
FIG. 3 is a perspective view of a plurality of continuous ribbons derived from the continuous web of FIG. 1.

In FIGS. 1 and 2, for example, the portions of the web 10 resulting in ribbons 12 and 16 are driven at $V_2$ whereas the portion resulting in ribbon 14 is driven at $V_3$. The velocity differential results in a differential draft. FIG. 3 illustrates in particular the ribbons 12, 14 and 16 being driven at their respective velocities. The speed of all ribbons should exceed the speed of the web 10 to maintain the appropriate tension in the web 10 and to cause a small amount of drafting. For example, $V_2$ is preferably 20% faster than $V_1$. Because two adjacent portions are pulled at a different velocity, the continuous web is split into two continuous ribbons. Although FIG. 2 illustrates a top view of these pair of converging belts for producing three continuous ribbons, the number of continuous ribbons derived from the continuous web depends on the number of pairs of converging belts and the number of velocity differentials created between adjacent portions of the continuous web.

Because the present invention utilizes differences in speed to create a travel distance differential, the ribbons may all be driven from the apparatus in the same direction. FIG. 3 further illustrates the ribbons 12, 14 and 16 being dispersed in the horizontal direction as illustrated by directional arrow 30. Preferably, there is no vertical velocity placed on the web 10 so that the ribbons 13, 14 and 16 may continue in a horizontal manner to be collected in yarn spinning heads or other drafting apparatus.

Referring now to FIGS. 2 and 4, the present invention includes a plurality of shafts, gears and pulleys for driving the assembly of converging belts. However, various combinations of shafts, gears, pulleys or other devices may be utilized to maintain the desired belt tension and guidance. The upper and lower belts in each pair of converging belts are synchronized to have a ratio of 1:1. Therefore, the upper and lower shafts driving a pair of converging belts rotate at the same speed. In the embodiment shown in FIG. 2, upper shafts 32 and 34 and are supported by pillow block bearings 36. The upper belts are supported on pulleys on the upper shafts 32 and 34. In FIG. 2, sprockets 38 are connected to one end of shafts 32 and 34. A pair of timing belts (not shown) are then connected between driver motors and the sprockets 38. FIG. 4 best illustrates lower shafts 40 and 42 synchronized with upper shafts 32 and 34, respectively.

Figure 5:
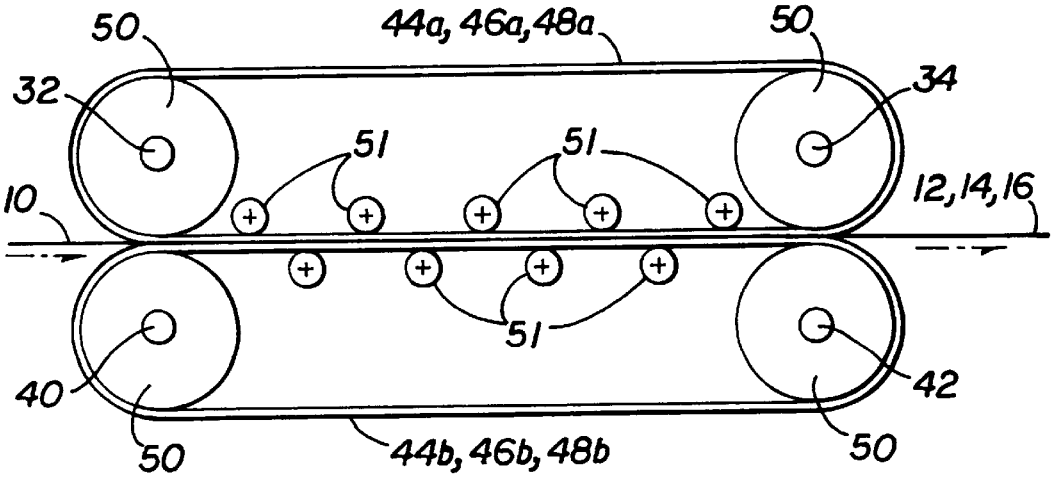
FIG. 5 illustrates an alternative embodiment of the present invention having a plurality of rollers persuading the converging belts against the incoming continuous web.

In FIG. 2, the shafts 32 and 34 are supporting three pair of converging belts 44, 46 and 48. Each pair of belts may be similar or varied in widths to produce ribbons of similar or varied widths. FIGS. 4–12 are side views of various embodiments of the present invention which best illustrate an upper belt and a lower belt for each pair of converging belts. In FIG. 2, shaft 32 drives the upper belts of the pair of converging belts 44 and 48 at the velocity $V_2$ which is greater than $V_1$. The pulley on shaft 32 for the upper belt of the pair of converging belts 46 is an idler that turns freely on shaft 32. Shaft 34 drives the upper belt of the pair of converging belts 46 and the pulleys on shaft 34 for the upper belts of the pairs of converging belts 44 and 48 are idlers that turn freely on shaft 34. In FIGS. 4 and 5, pulleys 50 on shafts 32 and 34 support the upper belts 44*a*, 46*a* and 48*a* and pulleys 50 on shafts 40 and 42 support lower belts 44*b*, 46*b* and 48*b*. In some embodiments, spacers may be used between adjacent pulleys or rollers to prevent belt wobble. Alternatively, one or more of the pulleys and/or rollers may be flanged. The flanged portion may be as tall as the width of the belts.

In the present invention, a pair of drivers may be used to drive the driver shafts. Each of the drivers may be operated separately to create and maintain the spread differential. However, because of friction, it may be preferable to start one driver and obtain one desired speed and then start the second driver; but then slowly increase the speed generated by the second driver to minimize friction. Also, in another alternative embodiment, a single positive differential driver with increased horsepower may be used. A single belt and differently sized sprockets may be used in conjunction with the single driver to create the speed differential while still minimizing friction.

Still referring to FIG. 4, one embodiment of the present invention includes at least one pair of pressure pads 54. Preferably, one pair of pressure pads 54 correspond with one pair of converging belts. The pressure pads 54 provide a gripping force on the belts for constraining portions of the web 10 which result in the ribbons.

As shown in FIG. 4, the pressure pads 54 are laterally spaced from one another and substantially coextensive. Also, the pressure pads 54 are preferably elongated and vertically opposed to each other. Each pair of pressure pads 54 cooperate to permit the upper and lower belts of one pair of belts to pass therebetween. In other words, the pressure pads are moveable with respect to each other from a spaced clearance position into a contact position relative to the belts passing therebetween. In the contact position, the pair of pressure pads 54 urge the pair of belts against the continuous web 10.

In FIG. 5, the pressure pads 54 are replaced with a plurality of freely turning rollers 51 to urge the pair of belts against the continuous web. Preferably, the rollers 51 are evenly spaced along the length of the coextensive portion of each pair of converging belts. However, the upper rollers 51 are offset from the lower rollers 51.

In other alternative embodiments, shown in FIGS. 6–10, the present invention includes an oversized wheel 56 in place of the rollers 51 and pressure pads 54 which creates less friction compared to the rollers 51 and pressure pads 54. The wheel 56 is oversized relative to the size of a single pulley 50 or roller 51. The wheel 56 is configured to engage and place pressure on at least one pair of converging belts. Belt tension is used against the wheel 56 to provide the desired gripping force applied to the respective ribbons. By placing pressure on the pair of converging belts, the pair of converging belts are urged against the continuous web. Preferably, the wheel 56 is sized relative to the length of the coextensive portion of a corresponding pair of converging belts such that griping force with the continuous web 10 is maximized. In other words, a large wheel 56 is desired in order to achieve a longer grip length. A diameter of approximately 20 inches for the wheel 56 is believed to be suitable for use with most known carding machines.

Figure 6:
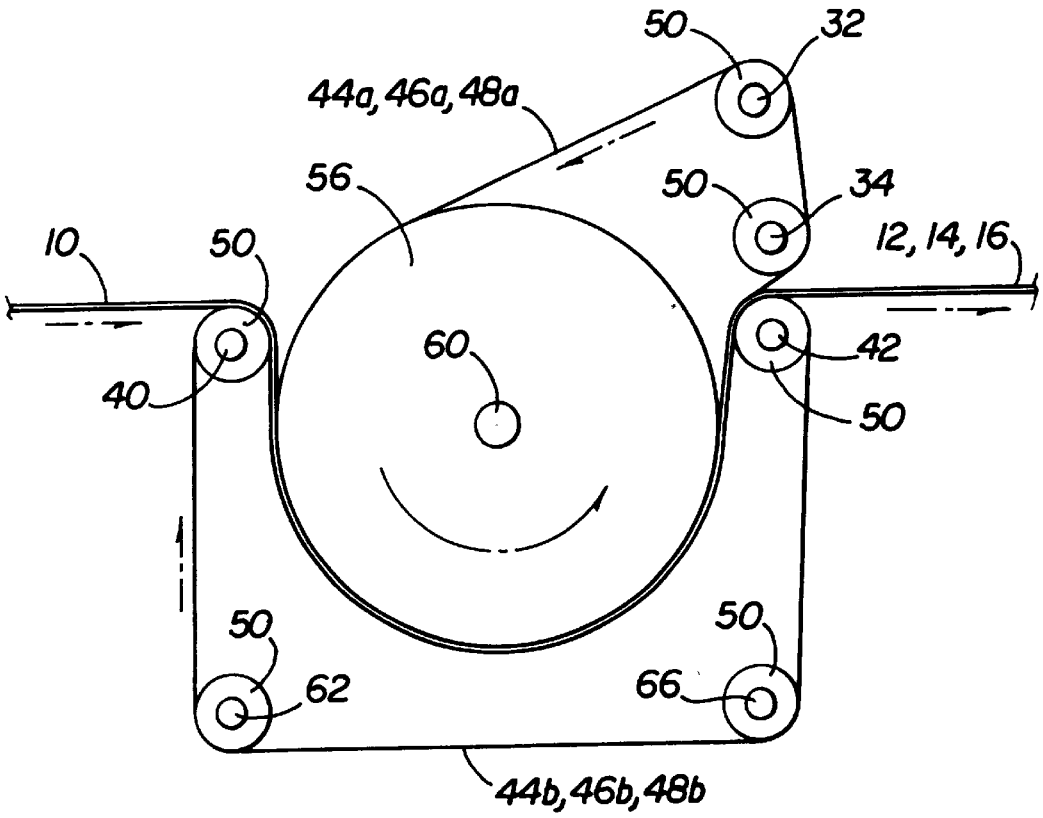
FIG. 6 illustrates an alternative embodiment where the pair of converging belts are persuaded against the continuous web by an oversized wheel.
Figure 7:
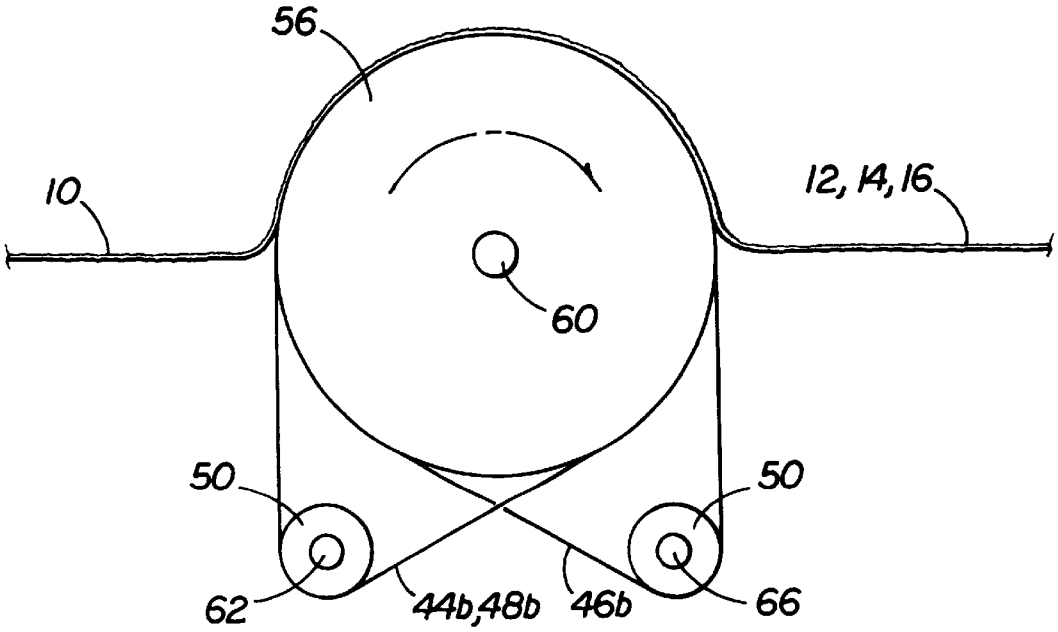
FIG. 7 illustrates an alternative configuration of the present invention utilizing the oversized wheel.

In FIG. 6, the pair of belts 44, 46 and 48 are supported on an assembly of pulleys 50 which are, in turn, carried by shafts 32, 34, 40, 42, 62 and 66. The wheel 56 is supported by shaft 60 and is permitted to freely rotate about shaft 60. Note that the shafts 40 and 42 are positioned above the shaft 60. In this embodiment, the web 10 is received from the left and passes over the pulleys 50 on shaft 40. At this point, the web 10 is only in contact with the lower belts 44*b*, 46*b* and 48*b*. However, as the web 10 continues to pass over the pulleys of shaft 40, the web 10 is received between the lower belts and the upper belts upon the wheels 56. The web 10 remains between the pair of belts while traveling below a horizontal plane through the axis of rotation of shaft 60. In other words, the web 10 is positioned between the coextensive portion of belts on the lower half of the wheels 56. However, shaft 34 is positioned approximately above shaft 42. This permits the web 10 to remain between the belts until the web 10 passes through a vertical plane intersecting the axis of rotation for the shafts 34 and 42 where the belts are no longer coextensive. Other configurations may be used to maintain the pair of converging belts 44, 46 and 48 upon a portion of their respective wheels 56.

In FIGS. 7–10, various other configurations of shafts and pulleys are demonstrated for use with wheels 56. The embodiment shown in FIG. 7, however, utilizes a set of three axially aligned wheels 56 that each preferably include cording pins (not shown) that will grip the web 10 and release the ribbons. Also, in FIG. 7, the wheels 56 rotate freely about shaft 60. Shaft 62 drives pulleys 50 for the lower belts 44*b* and 48*b* and, therefore, the two corresponding wheels 56. Shaft 66 drives pulley 50 which drives the lower belt 46*b* and, therefore, the middle wheel 56. Preferably, all three wheels 56 are grooved at their centerlines to receive and retain their respective belts.

Figure 8:
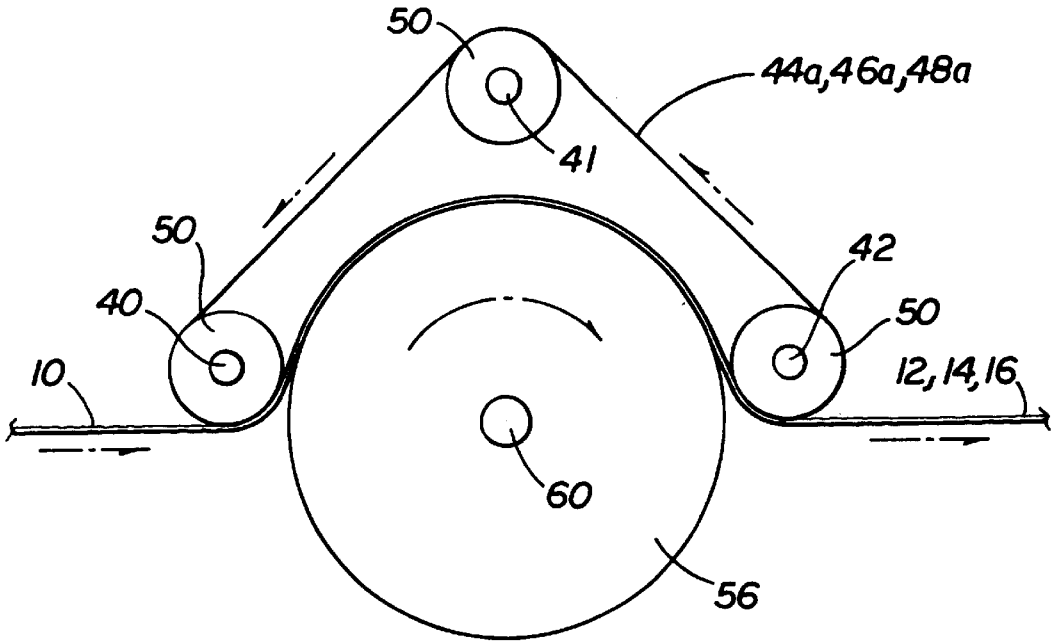
FIGS. 8 and 9 illustrate alternative pulley configurations of the present invention.
Figure 9:
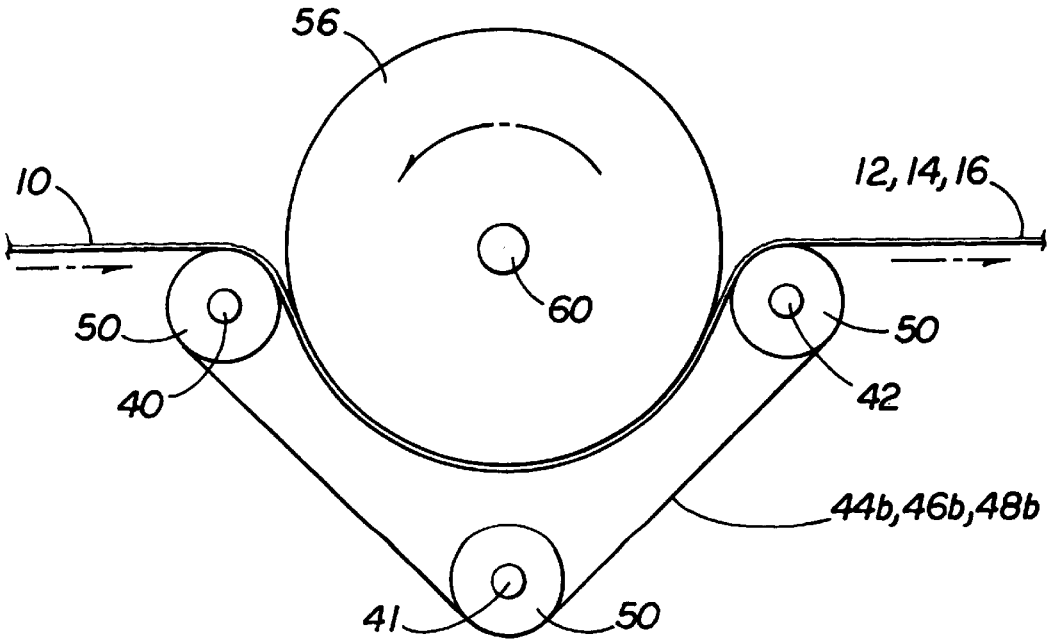

FIG. 8 illustrates an embodiment which includes only upper converging belts 42*a*, 44*a* and 46*a* and no other belts. In an embodiment such as this, a single set of belts converges against a body, such as the wheel 56. Alternatively, the body against which the single set of belts converge against may be a plurality of rollers or pressure pads as described above. FIG. 9 illustrates the same embodiment as shown in FIG. 8 except the configuration of belts is inverted. FIGS. 8 and 9 further include shafts 33 and 41, respectively, to further support the belts. The embodiments shown in FIGS. 8 and 9 are preferably utilized with the wheels 56 having an elastomer or fabric surface.

Figure 10:
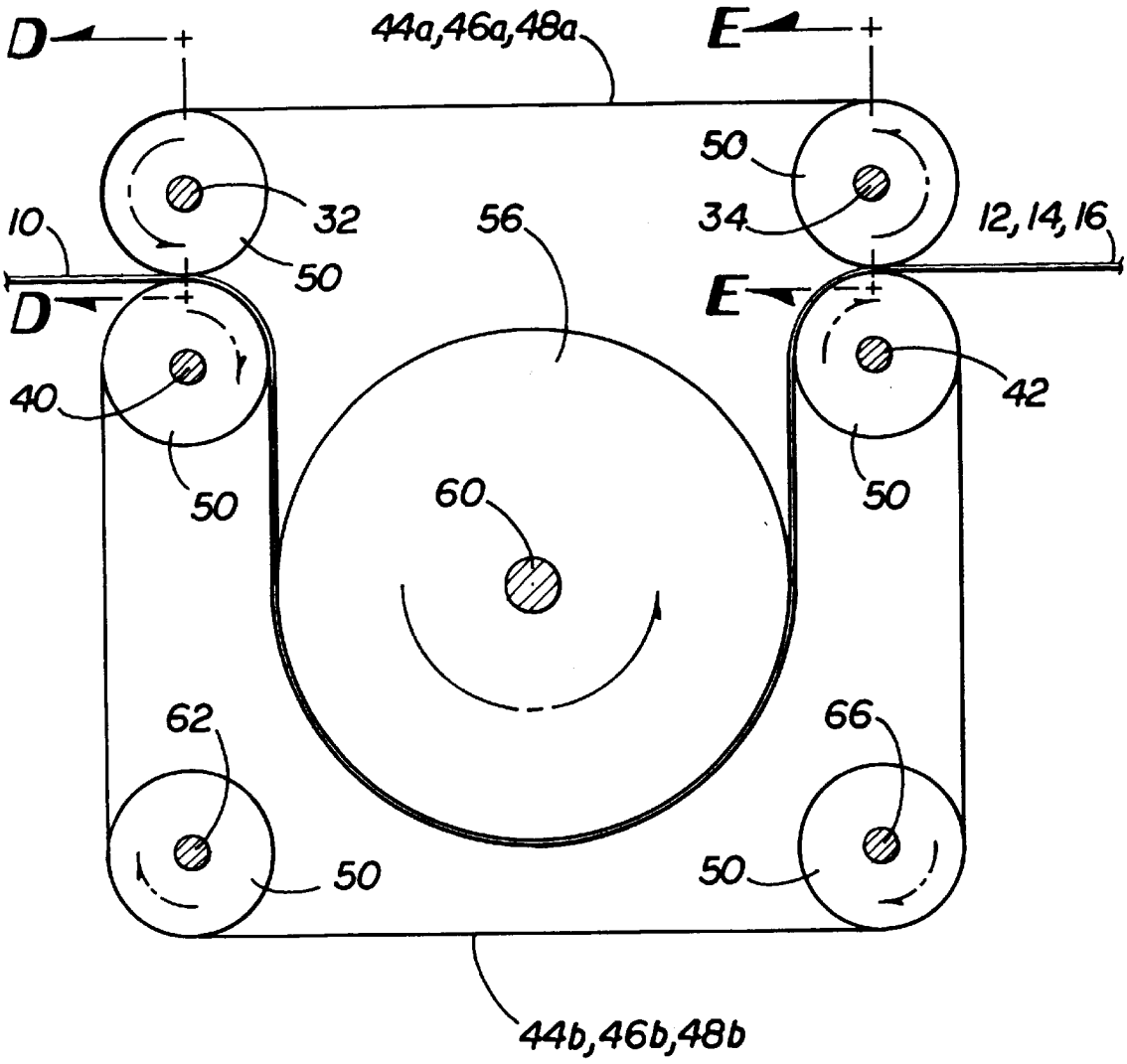
FIG. 10 illustrates a cross-sectional view taken along the line A—A of FIG. 2.
Figure 11:
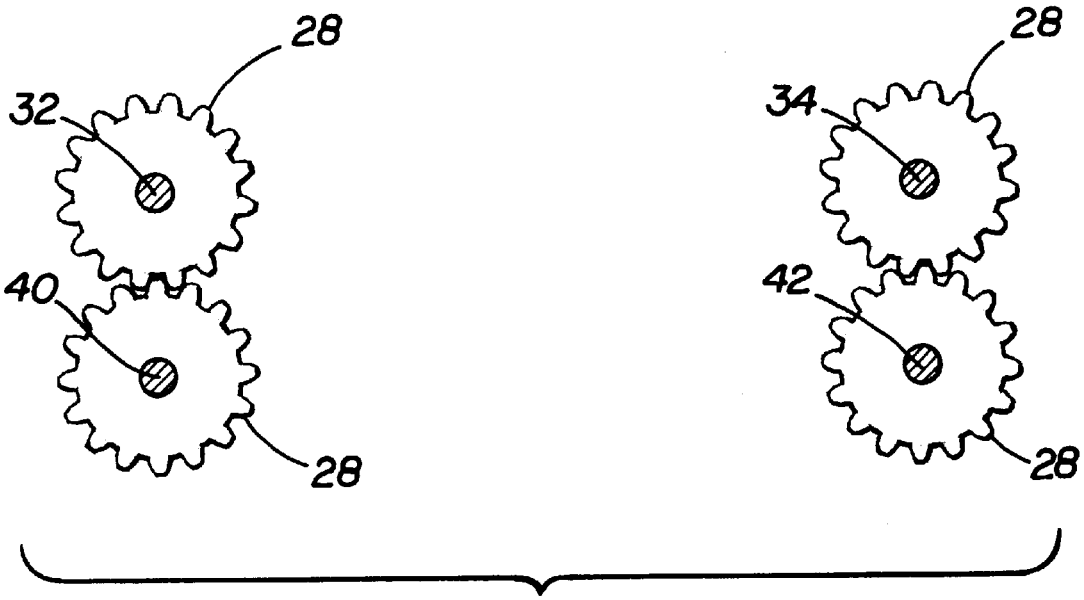
FIG. 11 illustrates a cross-sectional view taken along the line B—B of FIG. 2.

FIG. 10 illustrates a cross-sectional view taken along the line A—A of FIG. 2 and FIG. 11 illustrates a cross-sectional view taken along the line B—B of FIG. 2. FIG. 10 illustrates in particular a side view of the pair of belts 42*a–b*, 44*a–b* and 46*a–b* and the shafts 32, 34, 40, 42, 60, 62 and 66 in combination with the wheels 56. The preferred arrangement of the gears 28 are best illustrated in FIG. 11.

Figure 12:
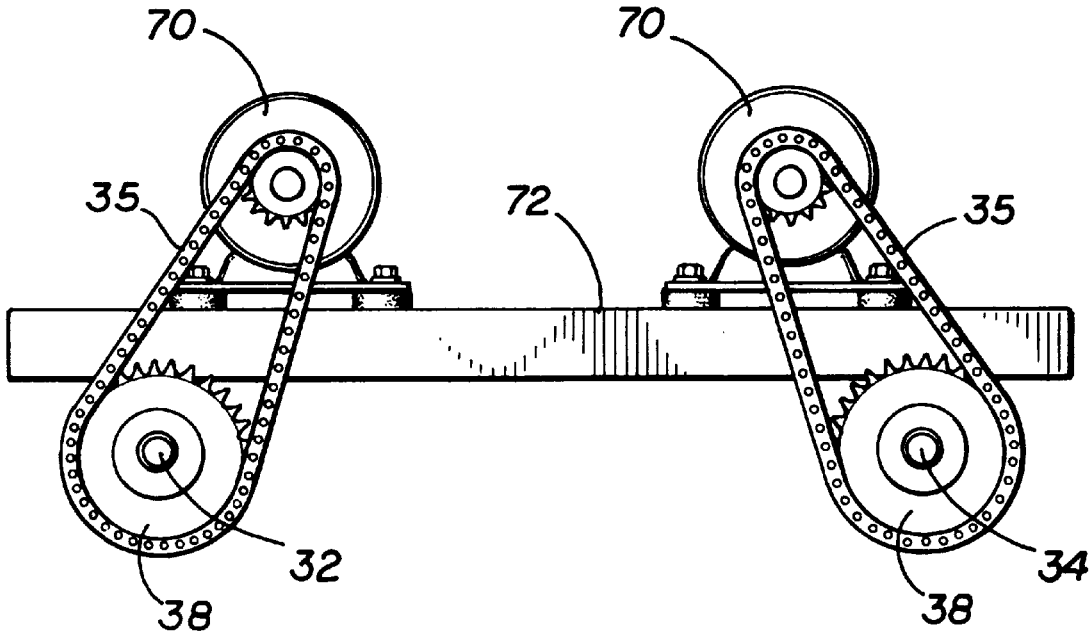
FIG. 12 illustrates a cross-sectional view taken along the line C—C of FIG. 2.

FIG. 12 illustrates a cross-sectional view taken along the line C—C of FIG. 2 and best illustrates adjustable speed motors 70 for driving shafts 32 and 34. The motors are coupled to the ends of the shafts 32 and 34. In this embodiment, the motors 70 are supported by frame member 72.

Figure 13:
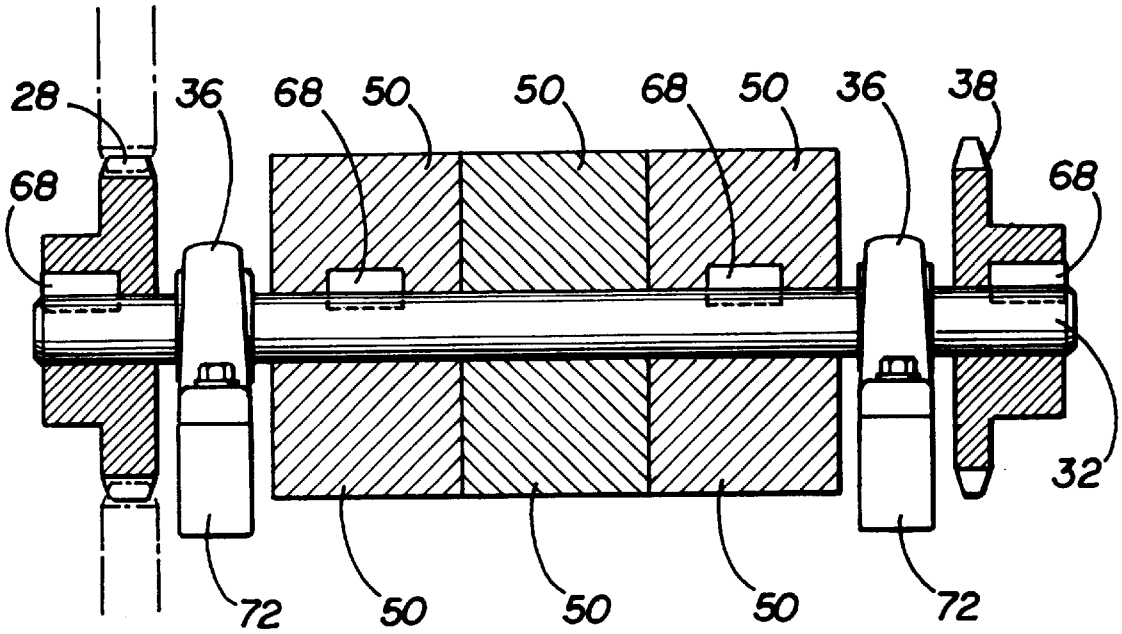
FIG. 13 illustrates a cross-sectional view taken along the line D—D of FIG. 10.
Figure 14:
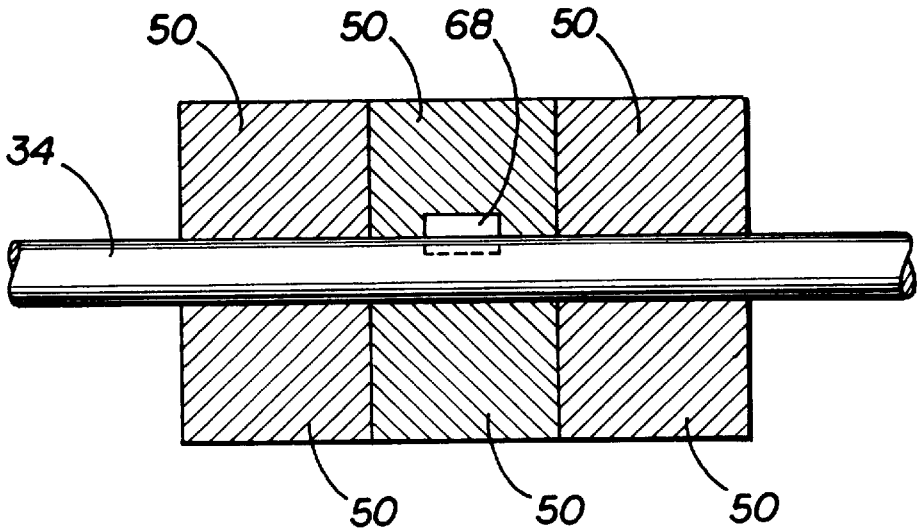
FIG. 14 illustrates a cross-sectional view taken along the line E—E of FIG. 10.

FIG. 13 illustrates a cross-sectional view taken along the line D—D of FIG. 10 and FIG. 14 illustrates a cross-sectional view taken along the line E—E of FIG. 10. As shown in FIGS. 13 and 14, keys 68 fix the two outer pulleys 50 to the shaft 32 in order to drive the belts 42*a* and 44*a*. The center pulley corresponding with the upper belt 44*a* is an idler. FIG. 14 illustrates the shaft 34 secured to the center pulley with a key 66. Keys 66 are also utilized to secure the sprocket 38 to the shaft 32 as shown in FIG. 13.

The present invention may also include an aspirator, vacuum, air mover or other device for generating an air flow to facilitate the separation of the ribbons 12, 14 and 16 from the belts of the present invention. The air may be supplied just prior to or immediately after the ribbons exit from between the converging belts. Alternatively, or in addition, a take-up roll may be used to take up each of the ribbons 12, 14 and 16 to prevent the ribbons 12, 14 and 16 from sticking to the belts and becoming caught.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. An apparatus for providing a plurality of ribbons for a continuous nonwoven web, said apparatus comprising a first assembly of belts converging toward an assembly of corresponding bodies, said belts and said bodies cooperating to receive and grip the continuous web therebetween, and one of said belts cooperating with one of said bodies adapted to vary the travel distance during a period of time of one portion of the continuous web relative to another adjacent portion of the continuous web to define a travel distance differential such that the continuous web is divided in a longitudinal manner in the direction of travel of the web into said portions of the continuous web, wherein said travel distance differential is created by varying the velocity of one of said portions of the continuous web relative to another portion of the continuous web.

2. The apparatus of claim 1 wherein said travel distance differential is approximately equal to the length of a fiber of the continuous web.

3. The apparatus of claim 1 wherein said body is a second assembly of belts cooperating with said first assembly of belts.

4. The apparatus of claim 1 wherein said body is a pressure pad.

5. The apparatus of claim 1 wherein said body is a plurality of rollers.

6. The apparatus of claim 1 wherein said body is a rotatable wheel.

7. An apparatus for providing a plurality of ribbons from a continuous nonwoven web, said apparatus comprising an assembly of converging belts, said assembly of converging belts comprising at least two pair of converging belts, each said pair of converging belts longitudinally adjacent to one another, each said belt of said pair of converging belts cooperating to receive and grip the continuous web therebetween, at least one of said pair of converging belts adapted to vary the speed of one portion of the continuous web relative to another portion of the continuous web such that adjacent portions of the continuous web travel a different distance during a period of time, thereby dividing the continuous web in a longitudinal manner in the direction of travel of the web into at least two continuous ribbons of desired width.

8. The apparatus of claim 7 further comprising a pulley assembly for each said belt of said pair of converging belts.

9. The apparatus of claim 7 wherein each of said converging belts are urged against the continuous web.

10. The apparatus of claim 7 further comprising a wheel configured to urge at least one of said pair of converging belts against the continuous web.

11. The apparatus of claim 10 wherein said wheel is sized relative to the coextensive length of each said pair of belts such that the contact with the continuous web is maximized.

12. The apparatus of claim 7 further comprising a pair of pressure pads, said pressure pads laterally spaced from one another and substantially coextensive, said pair of pressure pads cooperating to permit one of said pairs of belts to pass therebetween and to urge said one of said pair of belts against the continuous web.

13. The apparatus of claim 12 wherein said pressure pads are moveable with respect to each other from a spaced clearance position into a contact position relative to said belts.

14. The apparatus of claim 12 wherein said pressure pads are elongated and vertically opposed to each other.

15. The apparatus of claim 7 further comprising a plurality of rollers cooperating to permit one of said pair of belts to pass therebetween and to urge said one of said pair of belts against the continuous web.

16. The apparatus of claim 7 wherein the difference in speed between adjacent pairs of converging belts is in the range of approximately 4% to 10%.

17. An apparatus for providing a plurality of ribbons from a continuous nonwoven web, said apparatus comprising:

means for driving a first portion of the continuous web at a first velocity; and means for driving a second portion of the continuous web at a second velocity, thereby creating a travel distance differential to divide the continuous web in a longitudinal manner in the direction of travel of the web into said first and second portions to define two continuous ribbons of desired width.

* * * * *